US007819933B2

(12) United States Patent
Moon et al.

(10) Patent No.: US 7,819,933 B2
(45) Date of Patent: Oct. 26, 2010

(54) CYCLONE DUST COLLECTOR

(75) Inventors: Joo-sung Moon, Gwangju (KR); Dong-hun Yoo, Gwangju (KR); Ji-won Seo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 27 days.

(21) Appl. No.: 12/284,546

(22) Filed: Sep. 23, 2008

(65) Prior Publication Data

US 2009/0282792 A1 Nov. 19, 2009

Related U.S. Application Data

(60) Provisional application No. 61/127,563, filed on May 14, 2008.

(30) Foreign Application Priority Data

Jun. 26, 2008 (KR) ..... 10-2008-0060945

(51) Int. Cl.
*B01D 45/12* (2006.01)

(52) U.S. Cl. ..... 55/345; 55/346; 55/343; 55/349; 55/424; 55/429; 55/459.1; 55/DIG. 3; 15/352; 15/353

(58) Field of Classification Search ..... 55/345, 55/346, 343, 349, 424, 429, 459.1, DIG. 3; 15/353, 352
See application file for complete search history.

(56) References Cited

U.S. PATENT DOCUMENTS

| | | | | |
|---|---|---|---|---|
| 5,160,356 A | 11/1992 | Dyson | | 55/345 |
| 6,782,583 B2 * | 8/2004 | Oh | | 15/350 |
| 2004/0244139 A1 * | 12/2004 | Lee | | 15/353 |
| 2005/0252180 A1 * | 11/2005 | Oh et al. | | 55/345 |
| 2006/0123590 A1 | 6/2006 | Fester et al. | | |

FOREIGN PATENT DOCUMENTS

| | | |
|---|---|---|
| GB | 2406065 | 3/2005 |
| JP | 11-146850 | 6/1999 |
| KR | 1020030024102 | 3/2003 |
| KR | 1020050080918 | 8/2005 |
| KR | 1020050109199 | 11/2005 |
| KR | 100598600 | 7/2006 |

OTHER PUBLICATIONS

Combined Search and Examination Report dated Mar. 11, 2009 corresponding to Great Britain Patent Application No. GB0821446.2.

* cited by examiner

*Primary Examiner*—Jason M Greene
*Assistant Examiner*—Dung Bui
(74) *Attorney, Agent, or Firm*—Ohlandt, Greeley, Ruggiero & Perle, LLP

(57) ABSTRACT

A cyclone dust collector is provided, including a cyclone unit that includes a first cyclone unit including a cyclone chamber to separate dust from dust-laden air, and a second cyclone unit, which is mounted in the first cyclone unit, including a plurality of cones to separate fine dust, and a cover unit that is formed on the cyclone unit to gather air discharged from the second cyclone unit and guide the air outside the cyclone dust collector, wherein the first cyclone unit includes a blocking plate at a lower part of the first cyclone unit, the blocking plate including a plurality of holes that are in fluid communication with the plurality of cones.

10 Claims, 7 Drawing Sheets

CYCLONE DUST COLLECTOR

CROSS-REFERENCE TO RELATED APPLICATIONS

This application claims the benefit under 35 U.S.C. §119 of U.S. Provisional Application No. 61/127,563, filed in the USPTO on May 14, 2008, and under 35 U.S.C. §119 of Korean Patent Application No. 10-2008-0060945, filed in the Korean Intellectual Property Office on Jun. 26, 2008, the entire disclosures of both of which are incorporated herein by reference.

BACKGROUND OF THE INVENTION

1. Field of the Invention

The present disclosure relates to a cyclone dust collector, and more particularly to a cyclone dust collector that separates and collects dust from dust-laden air drawn in through a suction port assembly, and discharges filtered air.

2. Description of the Related Art

Vacuum cleaners generate a suction force using a suction motor mounted in a cleaner main body and draw dust-laden air therein from a surface being cleaned through a suction nozzle using the suction force. The dust-laden air passes through a cyclone dust collector mounted in the cleaner main body so that dust and contaminants are collected and filtered air is discharged outside the cleaner main body.

In such a cyclone dust collector, since connecting portions between the components are not firmly sealed, air leaks and loss of pressure in the cyclone dust collector thus occurs so that the suction force is weakened.

Therefore, conventional cyclone dust collectors must include a separate sealing device or a separate sealing member for sealing between the components, so the configuration of the cyclone dust collectors becomes complicated, resulting in uneasy maintenance and repair.

SUMMARY OF THE INVENTION

An aspect of embodiments of the present disclosure is to solve at least the above problems and/or disadvantages and to provide at least the advantages described below. Accordingly, an aspect of embodiments of the present disclosure is to provide a cyclone dust collector that solves sealing between the components that are connected to each other on its own so that the loss of pressure caused by a leak of air is minimized and the configuration of the cyclone dust collector is simplified.

In order to achieve the above-described and other aspects of embodiments of the present disclosure, a cyclone dust collector is provided including a cyclone unit that includes a first cyclone unit including a cyclone chamber to separate dust from dust-laden air, and a second cyclone unit, which is mounted in the first cyclone unit, including a plurality of cones to separate fine dust, and a cover unit that is formed on the cyclone unit to gather air discharged from the second cyclone unit and guide the air outside the cyclone dust collector, wherein the first cyclone unit includes a blocking plate at a lower part of the first cyclone unit, the blocking plate including a plurality of holes that are in fluid communication with the plurality of cones.

The blocking plate may include a plurality of protrusion pipes, each of which protrudes from the plurality of holes towards an inside of the first cyclone unit, and into which lower parts of the plurality of cones are inserted. The lower parts of the plurality of cones may be sealed with the plurality of protrusion pipes, respectively, by surface contact. The plurality of cones may narrow in a downward direction, and each include an extension unit that is formed at a circumference of a lower end of the cone to be pressed and inserted into each of the protrusion pipes.

The first cyclone unit may be integrally formed with the blocking plate by injection molding. The plurality of cones in the second cyclone unit may be integrally formed by injection molding.

The cover unit may include a first cover that is elastically sealed with the second cyclone unit through a gasket that is formed on an upper part of the second cyclone unit, and a second cover that is sealed with an upper part of the first cover by a surface contact. The first cover may include a plurality of discharge pipes that discharge air from the plurality of cones of the second cyclone unit, and a sealing protrusion that is formed on an upper surface of the first cover in a looped curve shape to include holes of the plurality of discharge pipes and that corresponds to an outline of a space of the second cover where air joins.

The first cover may include a plurality of connection protrusions that are inserted into a plurality of connection holes on the second cover, and the first cover may be connected to the second cover using a plurality of screws.

The cover unit may include a first cover that is formed on an upper part of the second cyclone unit and that includes a plurality of discharge pipes that discharges air from the plurality of cones of the second cyclone unit, and sealing protrusions that are formed on an upper surface and a lower surface of the first cover in a looped curve shape to include holes of the plurality of discharge pipes, and a second cover that is connected to an upper part of the first cover, wherein the first cover is sealed with the second cyclone unit by a surface contact using the sealing protrusion on the lower surface of the first cover, and the first cover is sealed with the second cover by a surface contact using the sealing protrusion on the upper surface of the first cover.

The first cyclone unit may be formed of a transparent material at least in part.

The cyclone dust collector may further include a dust receptacle that is formed under the cyclone unit, and is separated into a first dust chamber and a second dust chamber by a partition, wherein the dust receptacle includes at least one dust movement restriction rib that protrudes from a lower surface of the dust receptacle in order to prevent dust collected in the first dust chamber from moving by an inner air current.

BRIEF DESCRIPTION OF THE DRAWINGS

These and/or other aspects and advantages of the invention will become apparent and more readily appreciated from the following description and the accompanying drawings of which.

DETAILED DESCRIPTION OF EXEMPLARY EMBODIMENTS OF THE PRESENT DISCLOSURE

Figure 1:
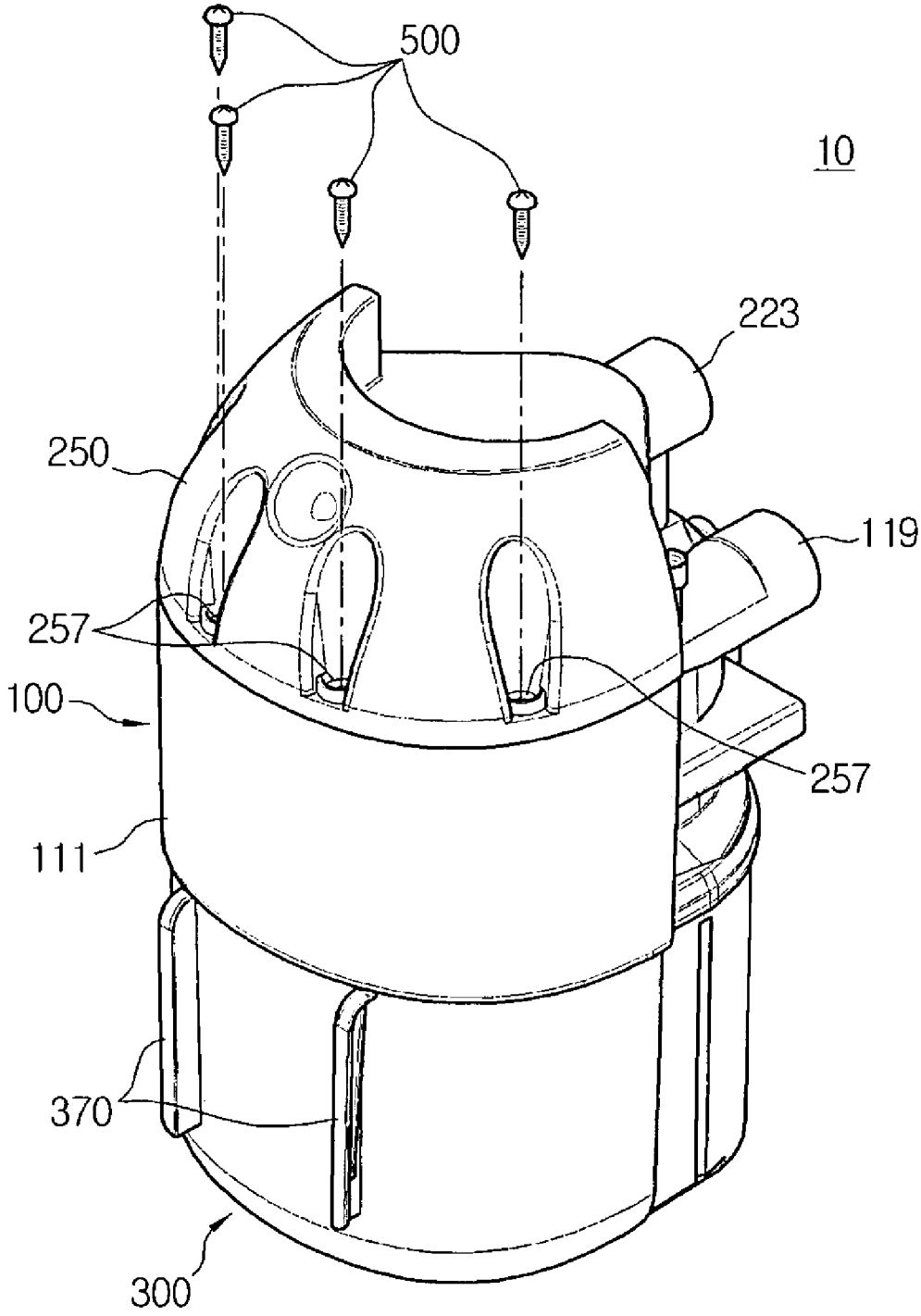
FIG. 1 is a perspective view illustrating a cyclone dust collector according to an exemplary embodiment of the present disclosure, that is separated from a cleaner body.

Reference will now be made to the accompanying drawings, wherein like reference numerals refer to like elements throughout. The embodiments are described below in order to explain the present disclosure by referring to the figures.

With reference to FIGS. 1 to 5, a cyclone dust collector 10 includes a cyclone unit 100, a cover unit 200, and a dust receptacle 300.

The cyclone unit 100 separates dust from dust-laden air drawn in from a surface being cleaned through a suction port assembly (not shown) of a cleaner main body (not shown) using a centrifugal force. The cyclone unit 100 includes a first cyclone unit 110 that separates large dust particles from dust-laden air, and a second cyclone unit 130 that separates fine dust from the air filtered by the first cyclone unit 110.

The first cyclone unit 110 includes a body 111 that has an open upper part. The body 111 includes a cyclone chamber 115 that is partitioned by a partition wall 113, a reception space 117 that receives a plurality of cones 133 of the second cyclone unit 130, and a guide pipe 119 that guides dust-laden air entering the cleaner main body (not shown) through the suction port assembly (not shown) to the first cyclone unit 110.

The body 111 is made to be transparent in part or as a whole so that a user can see through the inside of the body 111. A seal ring 140 is inserted along a lower end 111*a* of the body 111 in order to maintain an airtight connection between the dust receptacle 300 and the first cyclone unit 110 so that pressure inside the first cyclone unit 110 is prevented from being lowered and dust is prevented from leaking outside the cyclone dust collector 10. In addition, the body 111 is integrally formed with a blocking plate 112 by injection molding so that the lower part of the reception space 117 is closed and thus fine dust collected in a second dust chamber 350 of the dust receptacle 300 is prevented from entering the reception space 117. The blocking plate 112 includes a plurality of protrusion pipes 112*a* that protrude towards the reception space 117. The plurality of protrusion pipes 112*a* have the same low height in order to be airtightly connected to the plurality of cones 133, and are in fluid communication with the second dust chamber 350 so that fine dust that is separated from air and falls down from the plurality of cones 133 is collected in the second dust chamber 350.

The cyclone chamber 115 is eccentrically disposed in the body 111, and the reception space 117 is formed around a one side of the partition wall 113. A grill filter 116 is formed in the cyclone chamber 115 to prevent large dust particles separated from air using a centrifugal force from entering the second cyclone unit 130.

An upper end 116*a* of the grill filter 116 penetrates an air discharge hole 113*a* that is formed at the upper part of the partition wall 113, and is thus detachably connected to an air inlet hole 131 of the second cyclone unit 130. In addition, a skirt 116*b* protrudes from the circumference of a lower end of the grill filter 116 so that dust falling down in the dust receptacle 300 after being separated from air in the cyclone chamber 115 is prevented from flying and flowing backward to the cyclone chamber 115. A plurality of grill holes 116*c* are formed on the grill filter 116 in order to flow through air filtered by the cyclone chamber 115.

At one side of the second cyclone unit 130, there is the air inlet hole 131 through which primarily filtered air discharged from the air discharge hole 113*a* of the first cyclone unit 110 enters the second cyclone unit 130. At another side of the second cyclone unit 130, there is the plurality of cones 133 that are formed in a longitudinal direction of the cyclone dust collector 10 and are accommodated in the reception space 117 of the first cyclone unit 110. In addition, the second cyclone unit 130 includes a plurality of guide channels that are formed between the air inlet hole 131 and the plurality of cones 133 in order to guide air entering through the air inlet hole 131 to flow into an entrance 133*a* of each cone. The plurality of guide channels 132 are connected to the entrances 133*a* of the plurality of cones 133, respectively, in a tangential direction. Accordingly, air entering through the entrances 133*a* rotates in the plurality of cones 133 by receiving a rotation force so that fine dust can be separated from the air using a centrifugal force.

The plurality of cones 133 narrow downwards, and each include an extension unit 134 that extends vertically from the circumference of the lower end of the cone 133. When lower parts 133*b* of the plurality of cones 133 are pressed and inserted into the plurality of protrusion pipes 112*a* of the blocking plate, the external surface of the extension units 134 are sealed with the internal surface of the plurality of protrusion pipes 112*a*, respectively. Such a surface sealing between the extension units 134 and the protrusion pipes 112*a* can prevent fine dust that are not blocked by the blocking plate 112 from entering the reception space 117 through a space between the extension units 134 and the protrusion pipes 112*a*. In this regards, the reception space 117 is isolated from the plurality of cones 133 in order not to affect a discharging air current in the plurality of cones 133 so that loss of pressure in the cyclone unit 100 can be reduced and thus lowering of a suction force can be prevented.

The cover unit 200 is formed on the cyclone unit 100, and includes a first cover 210, a second cover 230, and an external cover 250.

The first cover 210 covers the upper part of the second cyclone unit 130. A gasket 400 is formed between the second cyclone unit 130 and the first cover 210 so that an airtight connection can be maintained between the second cyclone unit 130 and the first cover 210. The first cover 210 includes a plurality of discharge pipes 211 that correspond to the plurality of cones 133 of the second cyclone unit 130, respectively. The plurality of discharge pipes 211 penetrate a plurality of insertion holes 410 that are formed on the gasket 400, and are formed on the plurality of cones 133 and coaxially with the plurality of cones 133. A sealing protrusion 213 protrudes from the upper surface of the first cover 210 in order to maintain the airtight connection with the second cover 230. The sealing protrusion 213 has a looped curve shape to include upper parts 211*a* of the plurality of discharge pipes 211.

The second cover 230 is connected to the upper part of the first cover 210, and includes an external wall that forms a junction chamber 235 where air discharged from the discharge pipes 211 join. The outline of the junction chamber 235 corresponds to the looped curve of the sealing protrusion 213, so when the first cover 210 is connected to the second cover 230, an external surface 213*a* of the sealing protrusion 213 is sealed with an internal surface 231*a* of an external wall 231.

The second cover 230 includes a discharge pipe 233 that discharges air joining at the junction chamber 231 to the outside of the cyclone dust collector 10. The discharge pipe 233 is connected to a portion of a cleaner main body (not shown) in order to be in fluid communication with a suction motor (not shown) in the cleaner main body.

The external cover 250 is formed on the second cover 230 to protect the second cover 230.

Figure 2:
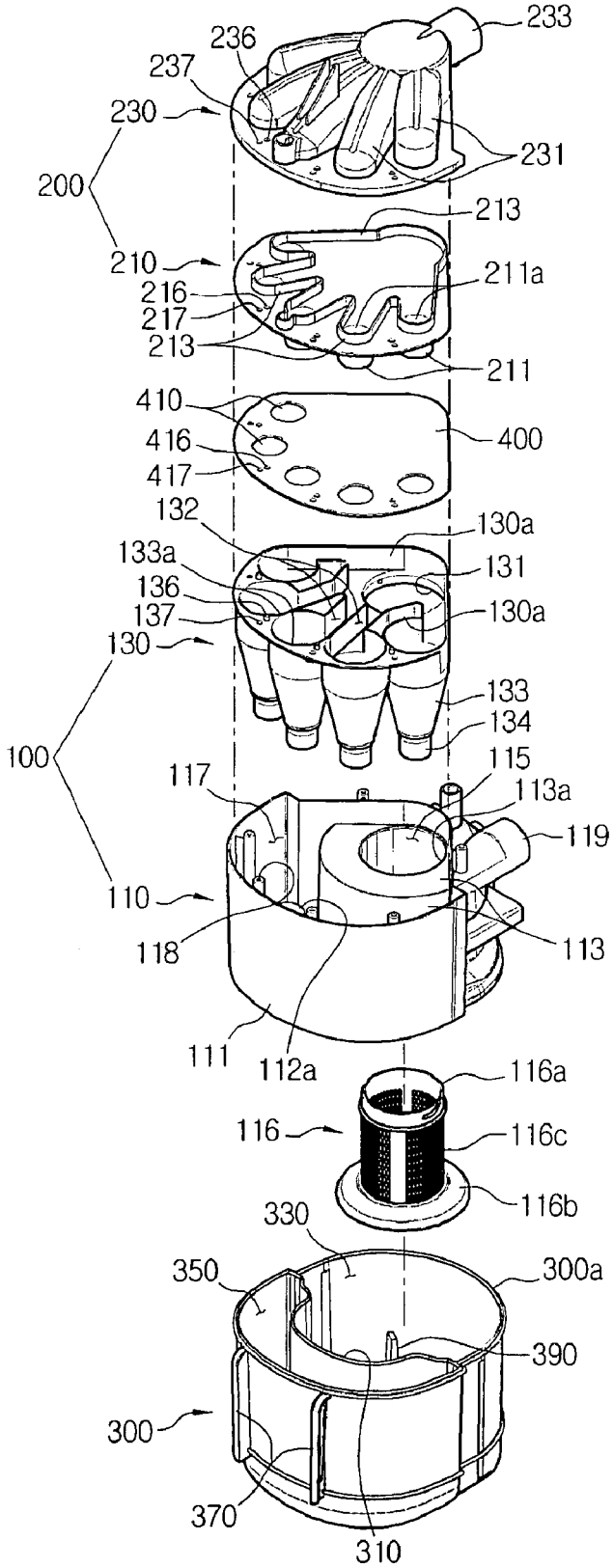
FIG. 2 is an exploded perspective view illustrating the cyclone dust collector according to an exemplary embodiment of the present disclosure, that is viewed at the top.
Figure 3:
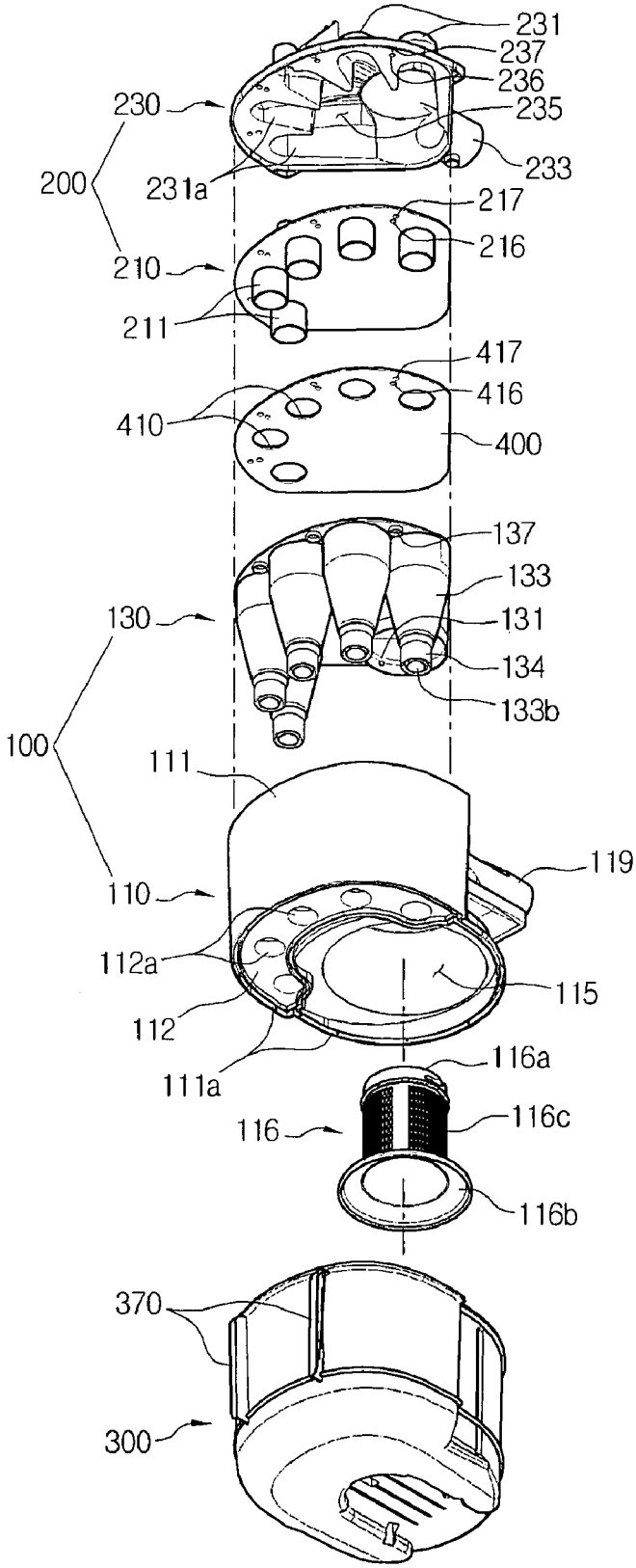
FIG. 3 is an exploded perspective view illustrating the cyclone dust collector according to an exemplary embodiment of the present disclosure, that is viewed at the bottom.
Figure 4:
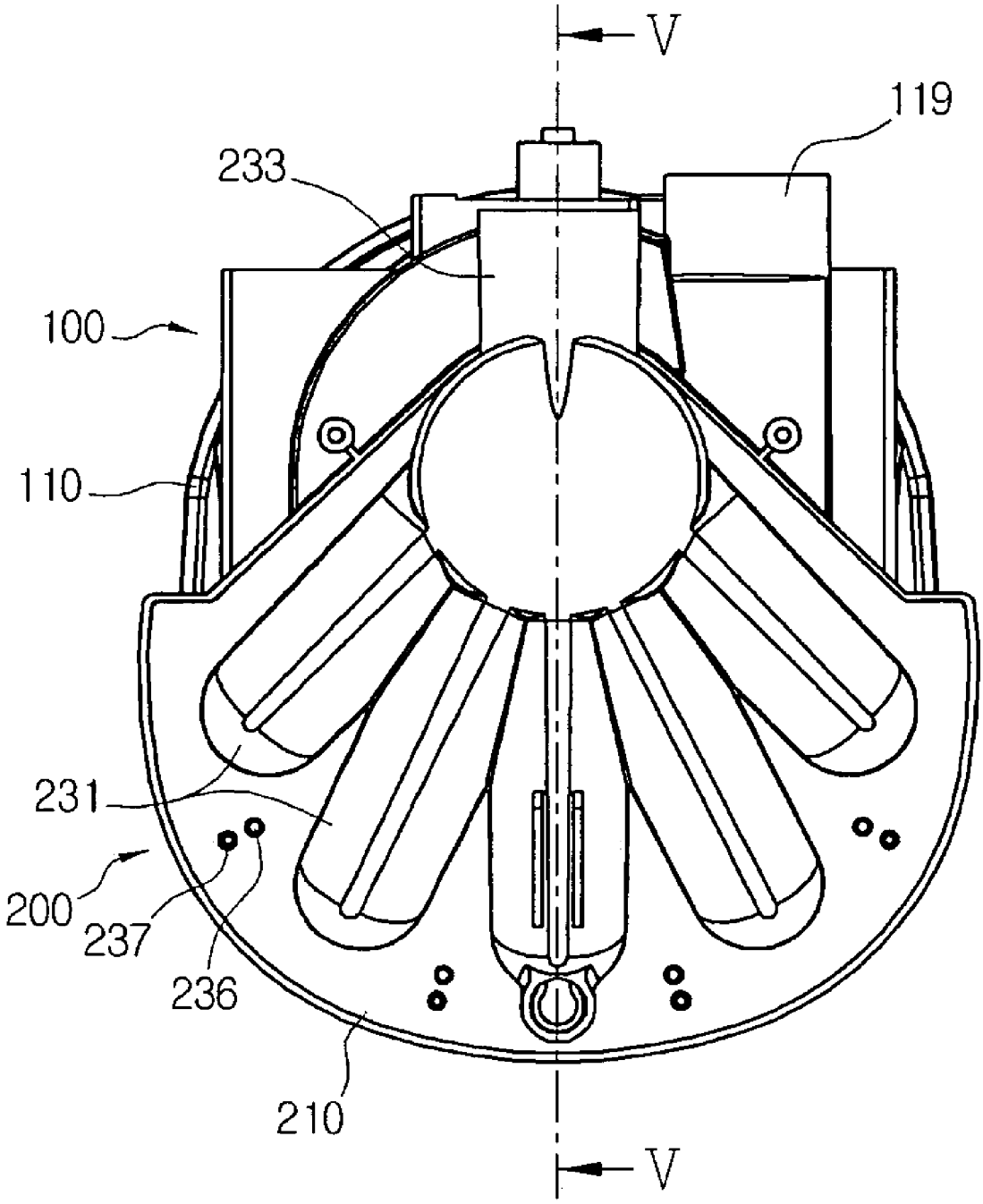
FIG. 4 is a plane figure illustrating the cyclone dust collector according to an exemplary embodiment of the present disclosure.

The cover unit 200 and the gasket 400 are formed on the cyclone unit 100 in sequence. With reference to FIGS. 1 and 2, a first connection is made by connecting a plurality of connection protrusions 136 that are formed on the second cyclone unit 130 to a plurality of connection holes 416, 216, and 236 that are formed on the gasket 400, the first cover 210 and the second cover 230, and a second connection is made by passing a plurality of screws 500 through a plurality of fastening holes that are formed on the external cover 250, the second cover 230, the first cover 210, and the second cyclone unit 130 in sequence, and fixing the plurality of screws 500 in a plurality of screw holes 118 of the first cyclone unit 110.

As described above, the first cyclone unit 110 and the second cyclone unit 130 are sealed together using surface connection between the extension units 134 and the protrusion pipes 112*a*, the second cyclone unit 130 and the first cover 210 are elastically sealed together using the gasket 410, and the first cover 210 and the second cover 230 are sealed together by connecting the external surface 213*a* of the sealing protrusion 213 to the internal surface 231*a* of the external wall 231. In such a manner, the cyclone unit 100 and the cover unit 200, where an air path is generated, are sealed together through several steps in order to prevent a leak of air and minimize loss of pressure. Consequently, lowering of a suction force of a vacuum cleaner as well as the cyclone unit 100 can be prevented.

Figure 6:
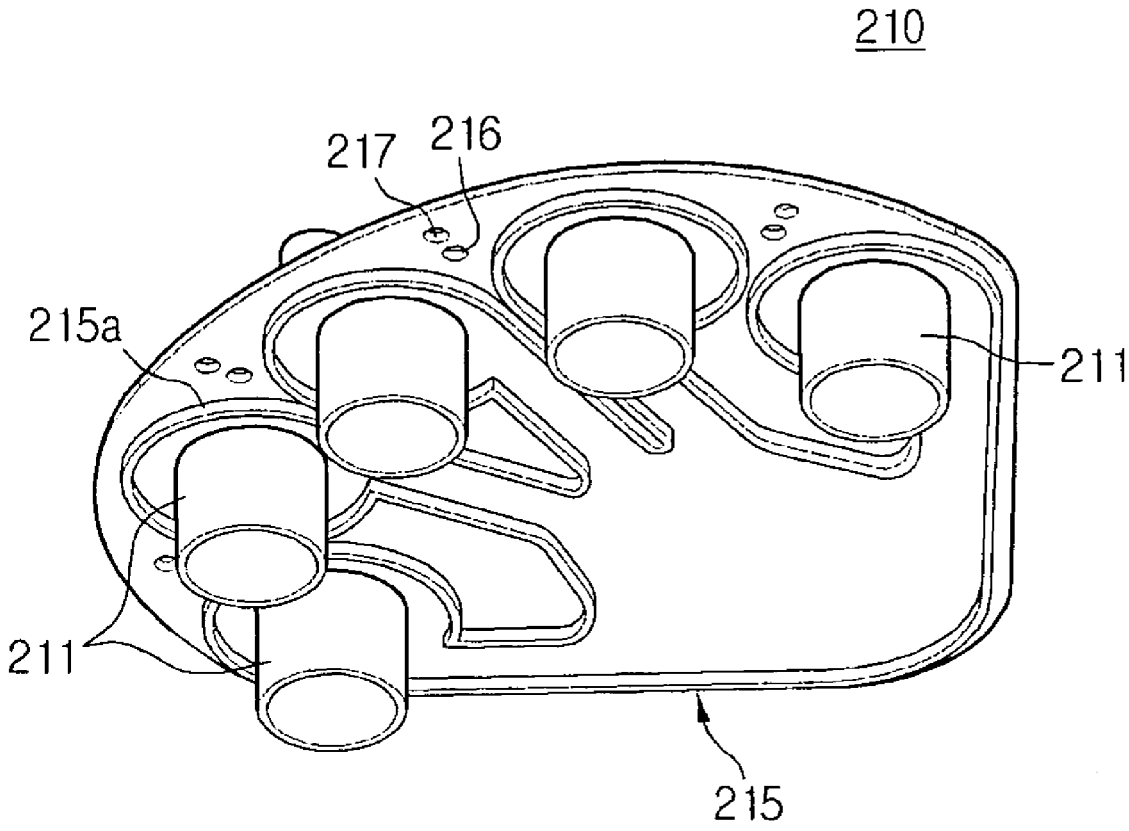
FIG. 6 is a perspective view illustrating another exemplary embodiment of a first cover of FIG. 3.
Figure 7:
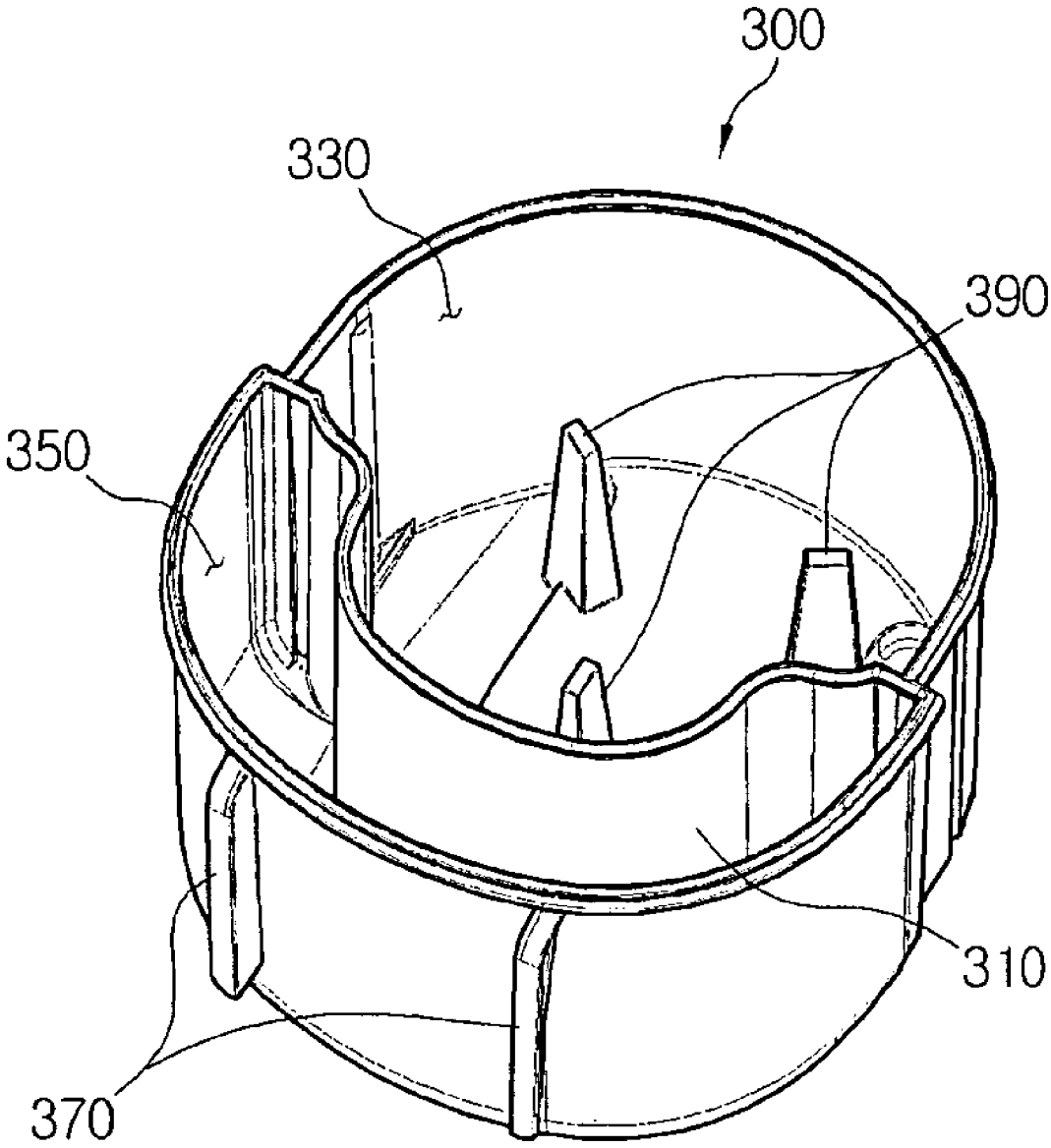
FIG. 7 is a perspective view illustrating dust movement restriction ribs of FIG. 2.

In this exemplary embodiment of the present disclosure, elastic sealing between the second cyclone unit 130 and the first cover 210 is enabled by inserting the gasket 400 therebetween, but the present disclosure is not limited thereto. Even if the gasket 400 is omitted, sealing between the second cyclone unit 130 and the first cover 210 is enabled by forming another sealing protrusion 215 that is formed under the first cover 210 in a looped curve around the plurality of discharge pipes 211, as illustrated in FIG. 6. Since the sealing protrusion 215 corresponds to an outline that is formed by the plurality of guide channels 132, the air inlet hole 131 of the second cyclone unit 130, and the entrances 133*a* of the plurality of cones 133, when the first cover 230 is connected to the upper part of the second cyclone unit 130, an external surface 215*a* of the sealing protrusion 215 is sealed with an internal surface 130*a* of the second cyclone unit 130 that forms the outline formed by the plurality of guide channels 132, the air inlet hole 131 of the second cyclone unit 130, and the entrances 133*a* of the plurality of cones 133. Therefore, the airtight connection can be maintained by a surface sealing between the second cyclone unit 130 and the first cover 210.

The dust receptacle 300 is mounted under the cyclone unit 100, and is separated into a first dust chamber 330 and the second dust chamber 350 by a partition 310. The first dust chamber 330 is formed in a position corresponding to the cyclone chamber 115 in order to collect large dust particles separated by the first cyclone unit 110. The second dust chamber 350 is formed in a position corresponding to the reception space 117 receiving the plurality of cones 133 in order to collect fine dust particles separated by the second cyclone unit 130.

The dust reception 300 includes a plurality of dust movement restriction ribs 390 that protrude from the lower surface of the dust receptacle 300 in order to prevent dust collected by the first cyclone unit 110 from moving by an inner air current of the first dust chamber 330.

The cyclone dust collector 10 having the configuration as described above is operated as follows.

If the suction motor (not shown) of the cleaner main body (not shown) is operated, the suction port assembly (not shown) draws dust-laden air into the cleaner main body from a surface being cleaned.

The dust-laden air enters the guide pipe 119 of the cyclone unit 100 along the cleaner main body (not shown).

Figure 5:
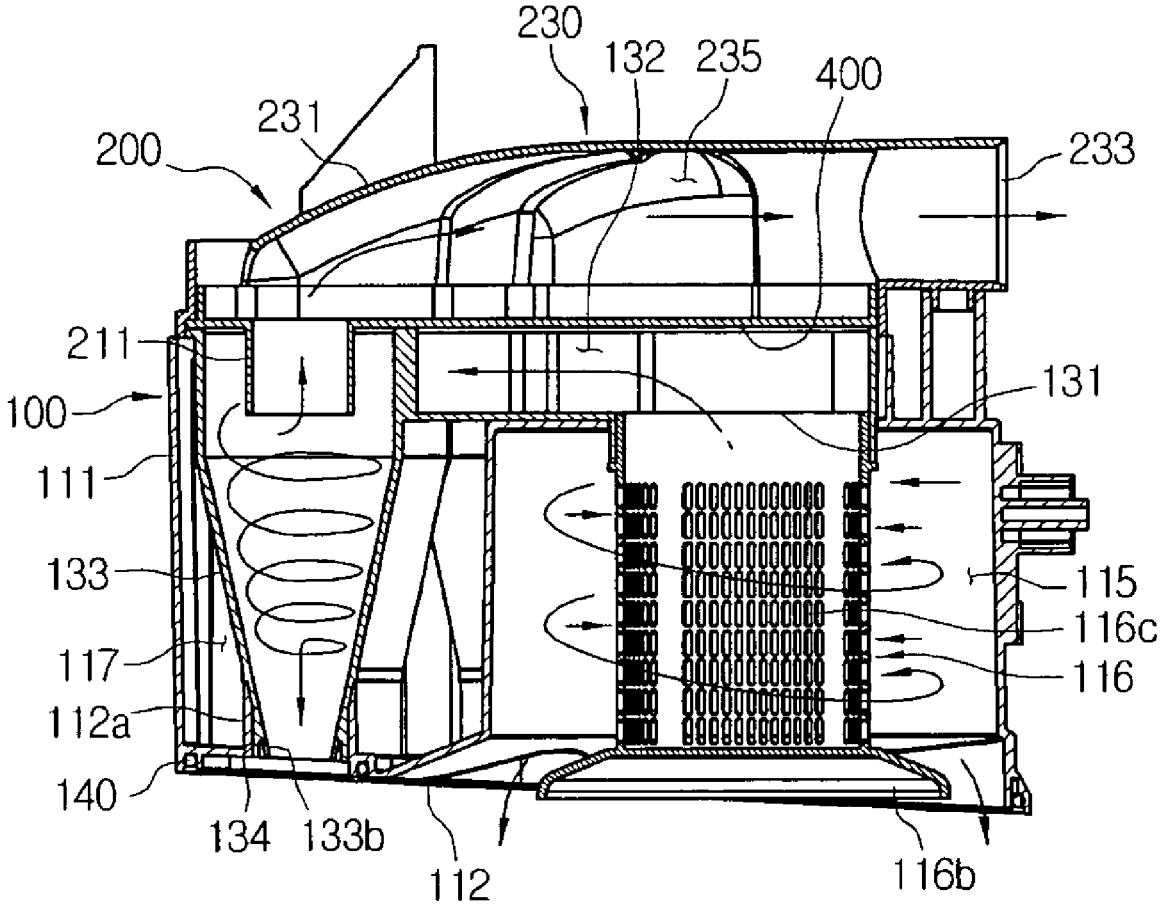
FIG. 5 is a cross-sectional view illustrating the cyclone dust collector that is cut along the V line as illustrated in FIG. 4.

With reference to FIG. 5, the dust-laden air enters the cyclone chamber 115 of the first cyclone unit 110 through the guide pipe 119, and rotates in the cyclone chamber 115 so that large dust particles are separated from the dust-laden air by a centrifugal force, rotate and fall down along the inner wall of the partition wall 113. Therefore, the large dust particles are accumulated in the first dust chamber 330, and the separated air enters the grill filter 116 through the grill holes 116*c*.

The air passes through the grill filter 116 and enters the second cyclone unit 130 through the air inlet hole 131. Subsequently, the air enters the plurality of cones 133 along the plurality of guide channels 132 and rotates in the plurality of cones 133 by a rotation force. Consequently, fine dust particles are separated from the air by a centrifugal force, fall down and are collected in the second dust chamber 350. The separated air is discharged from the plurality of cones 133 to the junction chamber 231 of the second cover 230 through the plurality of discharge pipes 211.

Subsequently, the air is discharged outside the cyclone dust collector 10 through the discharge pipe 233, moves along the cleaner main body (not shown), passes through the suction motor (not shown), and is finally discharged outside the cleaner main body (not shown).

As can be appreciated from the above description, since firm sealing is made between a cyclone unit and a cover unit, air leaks and loss of pressure in the cyclone dust collector are prevented so that a suction force is not weakened.

While the invention has been shown and described with reference to certain embodiments thereof, it will be understood by those skilled in the art that various changes in form and details may be made therein without departing from the spirit and scope of the invention as defined by the appended claims.

What is claimed is:

1. A cyclone dust collector, comprising:

a cyclone unit having a first cyclone unit and a second cyclone unit, the first cyclone unit comprising a cyclone chamber to separate dust from dust-laden air, the second cyclone unit comprising a plurality of cones to separate fine dust, and the second cyclone unit being mounted in the first cyclone unit; and a cover unit formed on the cyclone unit to gather air discharged from the second cyclone unit and guide the air outside the cyclone dust collector, wherein the first cyclone unit comprises a blocking plate at a lower part of the first cyclone unit, the blocking plate comprising a plurality of holes in fluid communication with the plurality of cones, and wherein the blocking plate comprises a plurality of protrusion pipes, each of the plurality of protrusion pipes protruding from the plurality of holes toward an inside of the first cyclone unit, and each of the plurality of cones having a lower part inserted into each of the plurality of protrusion pipes wherein the cover unit comprises: a first cover elastically sealed with the second cyclone unit through a gasket formed on an upper part of the second cyclone unit; and a second cover sealed with an upper part of the first cover by a surface contact, wherein the first cover comprises: a plurality of discharge pipes that discharge air from the plurality of cones of the second cyclone unit; and a sealing protrusion formed on an upper surface of the first cover in a looped curve shape to comprise holes of the plurality of discharge pipes and which corresponds to an outline of a space of the second cover where air discharged by the plurality of discharge pipes joins.

2. The cyclone dust collector of claim 1, wherein the first cyclone unit is integrally formed with the blocking plate by injection molding.

3. The cyclone dust collector of claim 1, wherein the plurality of cones in the second cyclone unit are integrally formed by injection molding.

4. The cyclone dust collector of claim 1, wherein the first cover comprises a plurality of connection protrusions that are inserted into a plurality of connection holes on the second cover, and the first cover is connected to the second cover using a plurality of screws.

5. The cyclone dust collector of claim 1, wherein the first cyclone unit is formed, at least in part, of a transparent material.

6. The cyclone dust collector of claim 1, further comprising:

a dust receptacle formed under the cyclone unit and separated into a first dust chamber and a second dust chamber by a partition, wherein the dust receptacle comprises at least one dust movement restriction rib protruding from a lower surface of the dust receptacle in order to prevent dust collected in the first dust chamber from moving by an inner air current.

7. The cyclone dust collector of claim 1, wherein the lower parts of the plurality of cones are sealed with the plurality of protrusion pipes, respectively, by a surface contact.

8. The cyclone dust collector of claim 7, wherein the plurality of cones get narrow downwards, and each comprise an extension unit that is formed at a circumference of a lower end of the cone to be pressed and inserted into each of the plurality of protrusion pipes.

9. The cyclone dust collector of claim 1, wherein the cover unit comprises:

a first cover that is formed on an upper part of the second cyclone unit and that comprises a plurality of discharge pipes that discharges air from the plurality of cones of the second cyclone unit, and sealing protrusions that are formed on an upper surface and a lower surface of the first cover in a looped curve shape to comprise holes of the plurality of discharge pipes; and a second cover that is connected to an upper part of the first cover, wherein the first cover is sealed with the second cyclone unit by a surface contact using the sealing protrusion on the lower surface of the first cover, and the first cover is sealed with the second cover by a surface contact using the sealing protrusion on the upper surface of the first cover.

10. The cyclone dust collector of claim 9, wherein the first cover comprises a plurality of connection protrusions that are inserted into a plurality of connection holes on the second cover, and the first cover is connected to the second cover using a plurality of screws.

* * * * *